US006089776A

United States Patent [19]

Kaufmann

[11] Patent Number: 6,089,776

[45] **Date of Patent: *Jul. 18, 2000**

[54] FLUID DISPENSING UTENSIL

[76] Inventor: Rainer Kaufmann, Schanzenstrasse 36, D-27753 Delmenhorst, Germany

[ * ] Notice: This patent is subject to a terminal disclaimer.

[21] Appl. No.: 08/630,515

[22] Filed: Apr. 10, 1996

Related U.S. Application Data

[63] Continuation-in-part of application No. 08/150,085, Nov. 12, 1993.

[30] Foreign Application Priority Data

May 14, 1991 [DE] Germany ..... 41 15 685
Apr. 30, 1992 [WO] WIPO ..... PCT/DE92/00361

[51] Int. Cl.[7] ..... B43K 5/00

[52] U.S. Cl. ..... 401/199; 401/198

[58] Field of Search ..... 401/199, 198, 401/196; 222/187; 239/45

[56] References Cited

U.S. PATENT DOCUMENTS

| | | | |
|---|---|---|---|
| 1,166,896 | 1/1916 | Garvey . | |
| 2,740,979 | 4/1956 | Bridy . | |
| 3,113,336 | 12/1963 | Langnickel . | |
| 3,479,122 | 11/1969 | Funahashi . | |
| 3,501,225 | 3/1970 | Martin et al. . | |
| 3,922,100 | 11/1975 | Saito . | |
| 3,993,409 | 11/1976 | Hart . | |
| 4,496,258 | 1/1985 | Tanaka et al. . | |
| 4,588,319 | 5/1986 | Niemeyer . | |
| 4,770,558 | 9/1988 | Frietsch . | |
| 5,290,116 | 3/1994 | Chang | 401/205 X |

FOREIGN PATENT DOCUMENTS

| | | | |
|---|---|---|---|
| 0 459 146 | 4/1991 | European Pat. Off. . | |
| 516538 | 12/1992 | European Pat. Off. | 401/199 |
| 8 76 10 | 9/1966 | France . | |
| 1 269 010 | 1/1969 | Germany . | |
| 1 461 588 | 8/1971 | Germany . | |
| 2 124 298 | 11/1972 | Germany . | |
| 2 424 918 | 4/1975 | Germany . | |
| 3 642 037 | 6/1988 | Germany . | |
| 3 824 941 | 2/1990 | Germany . | |
| 48-36844 | 2/1967 | Japan . | |
| 7 701 595 | 8/1978 | Netherlands . | |
| 422 575 | 4/1965 | Switzerland . | |
| 941439 | 11/1963 | United Kingdom . | |
| 2205280 | 12/1988 | United Kingdom | 401/199 |

*Primary Examiner*—David J. Walczak
*Attorney, Agent, or Firm*—Oppenheimer Wolff & Donnelly LLP

[57] ABSTRACT

A fluid dispensing utensil, such as a writing utensil, includes a container defining a first storage area for storing fluid, a second storage area and an opening therebetween, a tip, a capillary conveying line extending from the opening through at least a portion of the second storage area to the tip, and a capillary storage associated with the second storage area and in direct contact with the conveying line. The average capillarity of the capillary conveying line is substantially greater than the average capillarity of the storage.

50 Claims, 2 Drawing Sheets

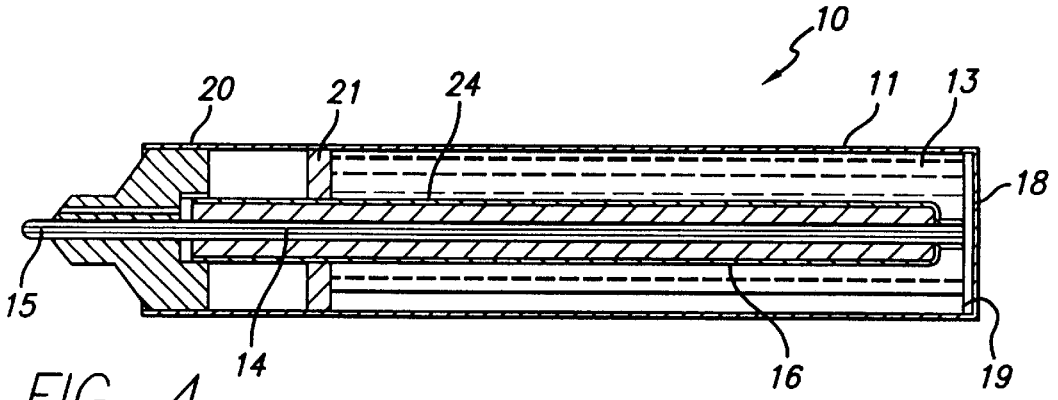
FIG. 4
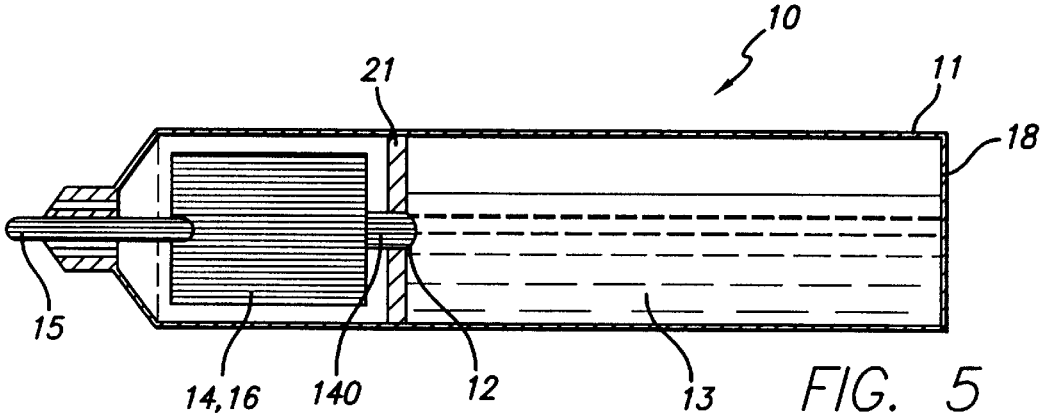
FIG. 5
FIG. 6
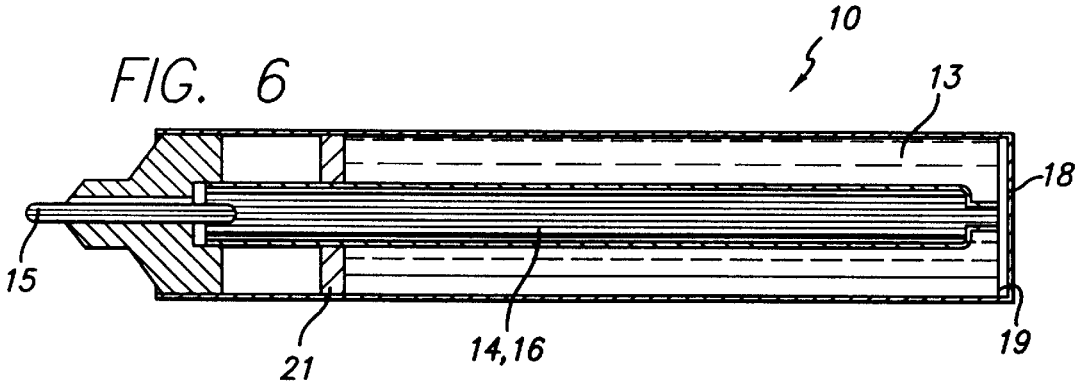
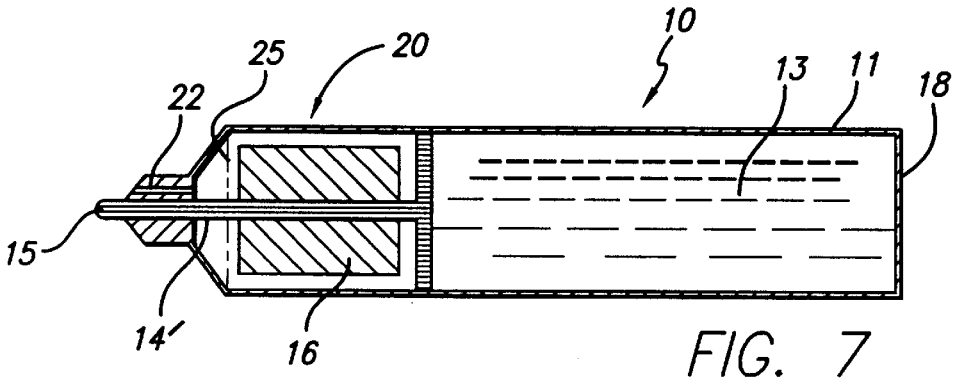
FIG. 7

FLUID DISPENSING UTENSIL

CROSS REFERENCE TO RELATED APPLICATION

This application is a continuation-in-part of co-pending U.S. application Ser. No. 08/150,085, filed Nov. 12, 1993.

BACKGROUND OF THE INVENTION

1. Field of Invention

The present invention relates generally to fluid dispensing utensils and, more particularly, to a fluid dispensing utensil which is adapted to prevent leakage.

2. Description of the Related Art

Fluid dispensing utensils are commonly used to deliver fluids such as ink, paint, adhesives, shoe polish, lotion, medicine, perfume, makeup, white out and food. In one type of fluid dispensing utensil, a relatively large volume of fluid is stored in a non-capillary container (or reservoir) where it is allowed to move freely. Pens which incorporate such a container, for example, are referred to as "free ink" pens. Fluid in these utensils is transferred from the container to the delivery end (often referred to as a tip or a nib) via a capillary conveying line. A vacuum is maintained within the container which prevents fluid in the conveying line from escaping from the utensil until the tip is brought into contact with the surface onto which fluid is to be dispensed. At this point, the force of attraction of the surface and the capillary force of the space between the surface and portions of the tip which are not in direct contact with the surface will cause the fluid to flow from the tip to the surface. As fluid is dispensed, air enters the container in a controlled manner via a precisely sized air inlet that is formed in the container and ends within the fluid. The air replaces the fluid so as to maintain the vacuum at a relatively constant level.

One problem associated with these dispensing devices is leakage caused by air expansion within the container. Specifically, when the air within the container is heated it expands. This causes the vacuum within the container to subside and increases the vapor pressure on the fluid. The reduced vacuum and increased vapor pressure cause the utensil to leak through the tip when oriented in the delivery orientation, i.e. when facing at least partially downwardly.

In an attempt to reduce these types of leaks, some ink pens include an overflow chamber having a capillary storage that will absorb ink. Fountain pens, for example, include a capillary storage in the front section and sometimes under the nib. This storage has a capillarity that is strong enough to prevent leakage when the pen is held in the writing position, but not so strong that it will be filled during a normal writing operation. The capillary storage will not receive fluid when there is substantial air expansion within the container. As a result, these capillary storage systems have been unable to prevent leakage from free ink pens which hold a relatively large volume of ink and, ultimately, a relatively large volume of air. They have also been unable to prevent the leakage caused by relatively large amounts of air expansion in smaller containers.

The storage capacity of existing fountain pen systems which are able to prevent leakage during temperature fluctuations associated with normal use is less than 2.0 milliliters. The reasons for this limitation are as follows. The conveying tube, which transfers fluid via capillary action, must be large enough to produce the desired ink flow during writing. The capillary storage consists of capillaries that must be larger than those of the conveying line. Otherwise, the storage would normally be filled with ink and unable to store excess ink as needed. The storage must also create enough capillary force to hold the ink when the fountain pen is being held vertically. Such force (which is often referred to as "capillary height") is inversely related to the size of the capillaries. Thus, in order to increase the volume of the storage, it is necessary to reduce the size of the capillaries. This is not possible, however, because the storage capillaries must be larger than those of the conveying line, which in turn must be large enough to insure proper ink flow. Accordingly, the volume of liquid that can be stored by the capillary storage is limited. This limits the amount of ink that can be stored in the reservoir.

Other pens include capillary storages configured such that the vast majority of the pores are smaller than the air inlet and are made of a material that is the same or substantially similar to that which forms the conveying line. As a result, the capillary storage will normally be completely filled with fluid and unable to receive additional fluid when air expands within the container. One proposed method of reducing this problem is to reduce the size of the air inlet. The proposed method has proven to be unsuccessful, however, due manufacturing limitations which make it prohibitively difficult to produce sufficiently small air inlets. Another proposed method of reducing this problem is to increase the size of the storage capillaries. This method has also proven unsatisfactory because the increase in pore size decreases the capillary height of the capillaries and reduces the amount of fluid that can be stored therein when the pen is in the upright position.

Still other pens include capillary storages that consist of a series of radially extending fins which form capillaries therebetween. There are a number of disadvantages associates with the fin-type capillary storages. For example, air interferes with the flow of ink back to the reservoir. In addition, fin-type capillary storages take up a relatively large portion of the overall volume of the pen, thereby substantially reducing the amount of volume available for the ink reservoir.

OBJECT AND SUMMARY OF THE INVENTION

The general object of the present invention is to provide a fluid dispensing utensil which obviates, for practical purposes, the aforementioned problems in the art. In particular, one object of the present invention is to provide a fluid dispensing utensil which is capable of storing a relatively large volume of fluid without leaking during periods of container air expansion. Another object of the present invention is to provide a fluid dispensing utensil which is relatively inexpensive and easy to manufacture.

In order to accomplish these and other objectives, the present fluid dispensing utensil includes a container, a capillary conveying line and a capillary storage in direct contact with the conveying line. The average capillarity of the storage is less than that of the conveying line, at least in the area of the opening between the container and the rest of the utensil. In addition, the lowest capillarity of the storage is substantially less than that of the conveying line. Due to these features, the vast majority of the capillary storage is normally free of fluid and will only store fluid during periods of air expansion. As air in the container contracts back to its original volume, fluid will be drawn out of the storage by the conveying line and returned to the container. The capillary conveying line may be configured such that some of capillaries in the conveying line are relatively small and transfer fluid, while others are relatively large and transfer air. This allows air and liquid to flow in parallel through the conveying line in opposite directions. In addition, the container may be configured such that air is only able to enter the container via the conveying line. Thus, the conveying line may be used to regulate the amount of air flowing into the container.

It should be noted that the descriptive term "capillarity" has been used herein to indicate the height up to which a liquid ascends within a pore of a given diameter. The greater the height, the greater the capillarity. In other words, the term "capillarity" is indicative of the attractive force between a liquid and a pore.

There are a number of advantages over prior fluid dispensing utensils associated with the present invention. The primary advantage of the present fluid dispensing utensil lies in the fact that it will reliably function under greater temperature fluctuations (and resulting air expansions) than utensils which are presently commercially available. This reliability will also extend to greater fluid storage volumes than commercially available utensils (10 ml or more). As noted above, fluid saturates the capillary storage in many prior dispensing utensils. This eventually results in undesired leakage. Conversely, the capillary storage in the present invention is substantially emptied each time the air expansion within the container subsides, thereby preventing the aforementioned leakage caused by full storages. In addition, the use of the conveying line as the air inlet eliminates the need to form a very small air inlet in the fluid container. As it is much easier to manufacture capillary conveying lines with pores that are often as small as one one-thousandth of an inch than it is to form an air inlet of similar dimensions in a molded plastic container, the present invention is less expensive to manufacture than prior utensils.

In one embodiment of the invention, the capillary conveying line extends to the bottom (or rearward) area of the container and is surrounded up to the bottom area by a tube. Fluid is unable to enter the conveying line when the utensil is in the dispensing orientation and the conveying line itself becomes the only source of fluid. Thus, this arrangement provides additional protection against leakage.

The conveying line and storage may also be in direct contact with one another. There are a number of advantages associated with this arrangement. For example, as the vacuum in the reservoir increases (due to a temperature decrease) and fluid begins to drain from the capillary storage, the capillaries in the conveying line will absorb essentially 100% of the fluid and return it to the reservoir. This would not occur there was a gap (and, therefore, air) between the storage and the conveying line. First, the conveying line capillaries could not help draw the fluid out of the storage, as they do when in direct contact with the storage. Also, the air would prevent the some of the fluid from entering the conveying line. Thus, after a few air expansion cycles, utensils with a gap will begin to leak.

The conveying line and the capillary storage may, in accordance with another embodiment of the invention, be integrally formed. As a result, the conveying line and storage may be manufactured in a single processing step to further reduce manufacturing costs.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 4 is a cross-section view of a fluid dispensing utensil in accordance with another preferred embodiment of the present invention;

FIG. 5 is a cross-section view of a fluid dispensing utensil in accordance with still another preferred embodiment of the present invention;

FIG. 6 is a cross-section view of a fluid dispensing utensil in accordance with still another preferred embodiment of the present invention; and FIG. 7 is a cross-section view of a fluid dispensing utensil in accordance with yet another preferred embodiment of the present invention.

DETAILED DESCRIPTION OF THE PREFERRED EMBODIMENTS

The following is a detailed description of a number of preferred embodiments of the invention. This description is not to be taken in a limiting sense, but is made merely for the purpose of illustrating the general principles of the invention. The scope of the invention is defined solely by the appended claims.

Figure 1:
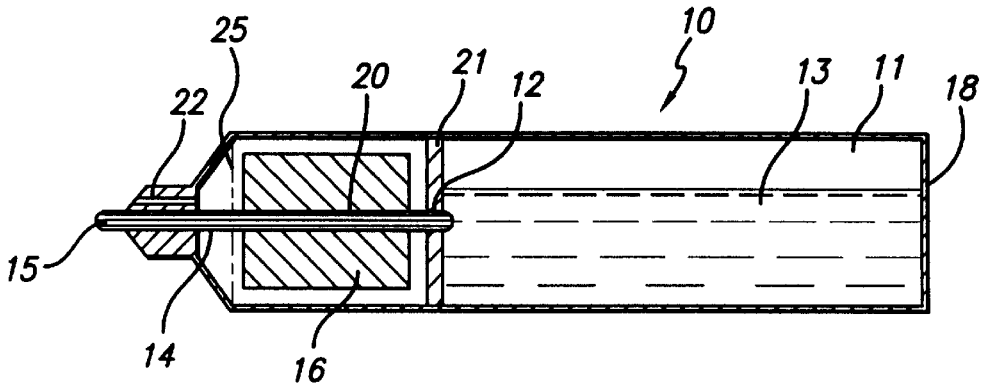
FIG. 1 is a cross-section view of a fluid dispensing utensil in accordance with a preferred embodiment of the present invention.

As shown by way of example in FIG. 1, a preferred embodiment of the present invention (generally represented by reference numeral 10) includes a housing 20 consisting of a container 11 for storing fluid 13 and an overflow chamber 25. Container 11 and overflow chamber 25 may be separated by a partition 21. It is to be understood, however, that partition 21 is only an exemplary representation of the boundary between the container and overflow chamber. An alternate boundary is discussed below with respect to FIG. 7. Container 11 may also be embodied in any suitable manner, either as an integral part of housing 20 or as a separate element connected to the housing. A tip 15 extends from one end of housing 20 in a known manner. An inlet 22 allows air to flow freely in to and out of overflow chamber 25.

Partition 21 includes an opening 12 which, as shown by way of example in FIG. 1, is closed by a capillary conveying line 14. The conveying line extends from opening 12 to tip 15 and is in direct contact with a capillary storage 16. The average capillarity of capillary storage 16 is smaller than the average capillarity of conveying line 14. Although the capillary storage is arranged about the periphery of capillary conveying line 16 in the embodiment shown in FIG. 1, there is no requirement that it extend all the way around the conveying line. Also, the strict separation of capillary storage 16 and conveying line 14 shown in FIG. 1 is not absolutely necessary.

Figure 2:
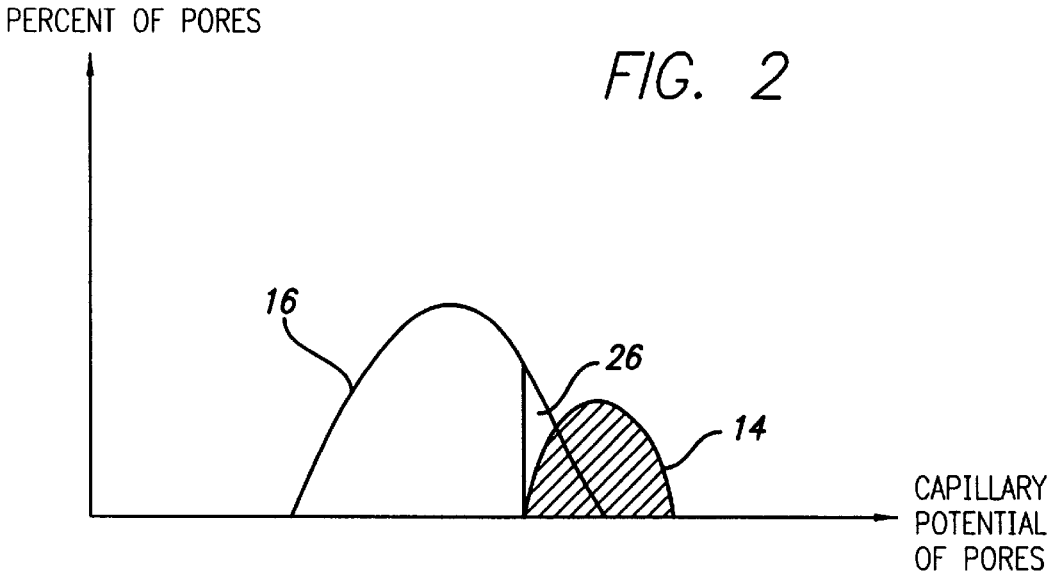
FIG. 2 is a diagram showing, for at least the area adjacent the opening between the container and the capillary storage chamber, the capillary potential of the pores in the capillary storage and capillary conveying line plotted against the percentage of pores.

A mixture of porous and/or fibrous materials may be provided which have a distribution of larger and smaller capillaries, such as the distribution shown in FIG. 2, within the material forming the capillary storage and conveying line. As the conveying line is formed from a number of small capillaries that are connected to one another, the same amount of fluid flow may be achieved with a larger single capillary tube. This advantageously allows the size of the storage capillaries to be reduced and the length of the storage increased, thereby increasing storage volume.

The conveying line and storage may be formed from any suitable material. However, such material should have a capillary structure and is preferably a porous material. Exemplary conveying line materials include fibrous materials, ceramics and porous plastics such as that manufactured by Porex in Atlanta, Ga. One exemplary fiber material is an acrylic material identified by type number C10010 that is manufactured by Teibow Hanbai Co. Ltd. This company is located at 10-15 Higashi Nihonbashi 3 Ohome, Chou-Ku, Tokyo 103, Japan. Additionally, the conveying line may also consist of a porous plastic tube which runs from the container to the tip. The end of tube adjacent the tip is closed and regulates air flow into the container. Exemplary storage materials include reticulated foam, which may range from hydrophilic to hydrophobic. The last mentioned type of foam may be used with non-water based liquids. The choice of foam depends, of course, on fluid type. One preferable reticulated foam is Bulpren S90 manufactured by Recticel, which is located at Damstraat 2, 9230 Wetteren, Belgium. Bulpren S90 is an open cell polyurethane foam based on polyester which averages 90 pores per inch. This foam is compressed to ⅓ of its original volume at 180 degrees Celsius to form the storage. This volume is maintained after the foam cools. Other storage materials include ceramics and porous plastics.

Figure 3:
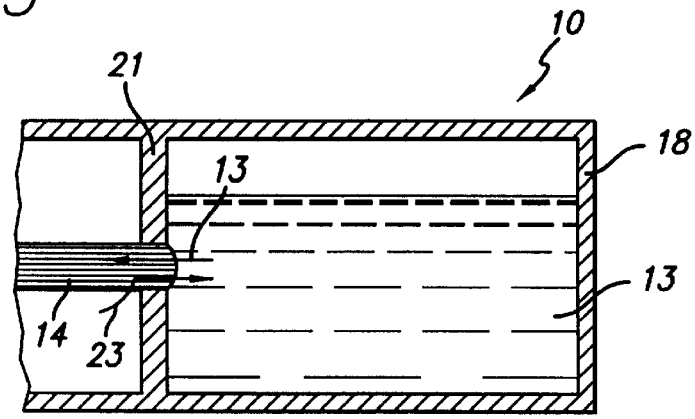
FIG. 3 is a cross-section view of the utensil shown in FIG. 1 illustrating the manner in which air enters the container and fluid exits the container.

The conveying line is press-fit into container opening 12 and provides the only path by which air can enter the otherwise closed fluid container 11. As a result, air flow into the container may be regulated with the conveying line. Specifically, as illustrated in FIG. 3, the finer capillaries of conveying line 14 transfer fluid 13 to the tip. The larger capillaries allow air 23 to enter the fluid container. At a minimum, air will enter through the largest capillary in the conveying line. The size of the larger pores which transport air and the amount that these pores are compressed during the press-fitting process will ultimately dictate the amount of air flow into the container. Container opening 12 and the press-fit portion of conveying line 14 are, therefore, one of the control mechanisms that regulate the flow of air into the container. Other control mechanisms include the capillatity of the conveying line.

As illustrated by the exemplary capillarity distribution shown in FIG. 2, the majority of storage 16 has a capillarity that is less than that of conveying line 14. In other words, the majority of the pores in storage 16 are larger than the majority of the pores in conveying line 14. There may be, however, a small percentage of pores in the storage that are smaller than or the same size as the largest air transporting pore in the conveying line. This portion of the storage is represented by the overlapping area 26 of the curves shown in FIG. 2. The few relatively small pores in the storage will normally be filled with fluid, while the larger pores will remain in a fluid-free state until there is air expansion within container 11. Advantageously, the diameter of the biggest pores of the conveying line is less than the average diameter of the pores of the storage.

When air expansion takes place within the container 11, a portion of the fluid in the container will be transferred through opening 12 and conveying line 14 into the normally fluid-free portions of capillary storage 16. In other words, capillary storage 16 receives the "excess" fluid and prevents uncontrolled leakage of the fluid from tip 15, or any other portion of the utensil. The "excess" fluid in capillary storage 16 will return to container 11 through conveying line 14 when the pressure in the container subsides. This process is repeated whenever temperature fluctuations, for example, cause air volume fluctuations within the container. As the fluid stored in capillary storage 16 is always returned to container 11, the capillary storage will not already be filled to capacity when there is an air expansion. Also, even though conveying line 14 is continuously wetted with fluid, at least in the area of opening 12, air cannot interrupt the return of the fluid to the container as long as there is fluid in the capillaries of the storage 16 which are larger than the largest pore in the conveying line 14.

Although the illustrated tip is an integral portion of conveying line 14, the present invention is not limited to such a configuration. The tip may also be a separate structural element, such as a stamp tip, foam tip, roller ball, or razor tip. Also, the size of the tip may be varied, even when the conveying line and tip are unitary, as applications require. Where the tip is formed from a porous material, its pores should be smaller than those of the conveying line in order insure that the fluid in the conveying line will toward the tip during dispensing.

Turning to the exemplary embodiments illustrated in FIGS. 4 and 6, conveying line 14 may be configured such that it extends into area 19 near container bottom 18. In these embodiments, the capillary storage and the capillary conveying line are enclosed by a tube 24. The tube provides additional protection against unwanted leakage. When the utensil is in the dispensing orientation, i.e., with the tip facing downwardly, the flow of fluid from the container to the conveying line is interrupted. The interruption occurs because there will not be any fluid in area 19, the only area from which fluid can transferred to the conveying line. The conveying line itself is essentially the only source of fluid.

The embodiment shown in FIG. 4 differs slightly from the embodiment shown in FIG. 6. Specifically, in the embodiment shown in FIG. 4, capillary storage 16 and capillary conveying line 14 are separate structural elements and the conveying line extends into bottom area 19. In the embodiment shown in FIG. 6, a mixture of porous materials having the requisite combination of capillary sizes form a unitary capillary storage 16 and conveying line 14.

In the exemplary embodiment shown in FIG. 5, conveying line 14 and capillary storage 16 define a unitary structural element similar to that shown in FIG. 6. In this embodiment, however, rear portion 140 of the integral conveying line and capillary storage is tapered so that it may be received in opening 12. In order to ensure that there is a sufficient amount of fine, fluid transferring capillaries in the container opening, this portion of the combined conveying line/storage may be pinched together at the opening in a defined manner. Rear portion 140 may also be provided as a separate element that is connected to the capillary storage.

As shown by way of example in FIG. 7, capillary conveying line 14' may be configured such that it includes a radially extending portion that separates the container from the overflow chamber. The conveying line and radially extending portion fill the opening between the container and the overflow chamber. The pores in the radially extending portion may be substantially similar to those in the conveying line and allow air to pass, but block the flow of fluid. As a result, the radially extending portion may be used to regulate the flow of air into the container.

With respect to the fluid itself, the present invention is capable of storing and dispensing a variety of fluids. For example, where the utensil is to be used as a pen, then ink is used. Other fluids include deodorant, perfume, medicines such as acne medicine, balms, lotions, makeup, lipstick, paint, adhesives (whether microencapsulated or not), white out, shoe polish and food stuffs. In order to accommodate these different types of fluids, the pore size and pore volume of the conveying line and storage must be varied in accordance with the viscosity and particle size of the fluid. For example, when the fluid is a typical writing fluid, the diameters of the capillaries (or pores) in the conveying line may range from 0.01 mm to 0.05 mm and the capillary (or pore) diameters in the storage may range from 0.02 mm to 0.5 mm, with a distribution similar to that shown in FIG. 2. Pore sizes and volumes are increased for larger particle sizes and higher viscosities and, conversely, are reduced for smaller particle sizes and lower viscosities.

Although the present invention has been described in terms of the preferred embodiment above, numerous modifications and/or additions to the above-described preferred embodiments would be readily apparent to one skilled in the art. For example, the utensil may be of the "break seal to initiate" variety. Such utensils include a stopper that prevents fluid from entering the conveying line until the consumer is ready to use the utensil for the first time. This keeps the both the fluid and the conveying line fresh. Another exemplary modification is the addition of a secondary reservoir located near the tip. Such a reservoir could have a capillarity similar to that of the conveying line and would increase the amount of fluid available during dispensing. It is intended that the scope of the present invention extends to all such modifications and/or additions and that the scope of the present invention is limited solely by the claims set forth below.

What is claimed is:

1. A writing utensil, comprising:

a container defining a first storage area for storing writing fluid, a second storage area and an opening therebetween;

a writing tip;

a capillary conveying line completely filling the opening and extending from the opening through at least a portion of the second storage area to the writing tip, the capillary conveying line defining first capillaries adapted to transport air through the opening, second capillaries adapted to transport fluid from the first storage area to the tip, the capillary conveying line defining a first predetermined average capillarity and a first predetermined uppermost capillarity; and a capillary storage associated with the second storage area, in direct contact with the capillary conveying line, and separated from the first storage area such that the capillary storage only comes into contact with writing fluid from the first storage area by way of the capillary conveying line, the capillary storage defining a second predetermined average capillarity and a second predetermined uppermost capillarity, the second predetermined average capillarity being substantially less than the first predetermined average capillarity and the second predetermined uppermost capillarity being substantially less than the first predetermined uppermost capillarity.

2. A utensil as claimed in claim 1, wherein the capillaries in the conveying line define diameters substantially between approximately 0.01 mm and 0.05 mm and the capillaries in the storage define diameters substantially between approximately 0.02 mm and 0.5 mm.

3. A fluid dispensing utensil, comprising:

a container defining a first storage area for storing fluid, a second storage area and an opening therebetween;

a tip;

a capillary conveying line completely filling the opening and extending from the opening through at least a portion of the second storage area to the tip, the capillary conveying line defining a first predetermined average capillarity and a first predetermined uppermost capillarity; and a capillary storage associated with the second storage area, in direct contact with the capillary conveying line, and separated from the first storage area such that the capillary storage only comes into contact with fluid from the first storage area by way of the capillary conveying line, the capillary storage defining a second predetermined average capillarity and a second predetermined uppermost capillarity, the second predetermined average capillarity being substantially less than the first predetermined average capillarity and the second predetermined uppermost capillarity being substantially less than the first predetermined uppermost capillarity.

4. A utensil as claimed in claim 3, further comprising:

a partition separating the first and second storage areas, the partition having a hole which defines the opening between the first and second storage areas, the hole being completely filled by the capillary conveying line.

5. A utensil as claimed in claim 4, wherein the partition comprises a tube.

6. A utensil as claimed in claim 5, wherein the tube extends to approximately the bottom of the container and the hole is substantially adjacent to the bottom of the container.

7. A utensil as claimed in claim 3, wherein the tip comprises a writing tip.

8. A utensil as claimed in claim 3, wherein the capillary conveying line comprises first capillaries adapted to transport air and second capillaries adapted to transport fluid.

9. A utensil as claimed in claim 3, wherein the capillary conveying line and the capillary storage define a single unitary structure.

10. A utensil as claimed in claim 3, wherein the capillary conveying line comprises at least one of a porous material and a fibrous material.

11. A utensil as claimed in claim 3, wherein the capillary storage comprises at least one of a porous material and a fibrous material.

12. A utensil as claimed in claim 3, wherein the second predetermined average capillarity is substantially less than the first uppermost predetermined capillarity.

13. A utensil as claimed in claim 12, wherein the capillary conveying line comprises first capillaries adapted to transport air and second capillaries adapted to transport fluid and is compressed within the opening in such a manner that the first capillaries define the sole path for air travel into the container.

14. A utensil as claimed in claim 3, wherein the capillary storage comprises a foam material.

15. A utensil as claimed in claim 14, wherein the foam material comprises a reticulated foam.

16. A utensil as claimed in claim 14, wherein the foam material is substantially hydrophilic.

17. A utensil as claimed in claim 14, wherein the foam material is substantially hydrophobic.

18. A utensil as claimed in claim 3, wherein the capillary storage comprises porous plastic.

19. A utensil as claimed in claim 3, wherein the capillary storage comprises a ceramic material.

20. A utensil as claimed in claim 3, wherein the capillary conveying line comprises a porous plastic tube.

21. A utensil as claimed in claim 3, wherein the capillary conveying line and the tip define a unitary structure.

22. A utensil as claimed in claim 3, wherein the capillary conveying line defines a radially extending portion that separates the first and second storage areas.

23. A utensil as claimed in claim 3, wherein the capillary conveying line comprises first conveying capillaries adapted to transport air and second conveying capillaries adapted to transport fluid, the storage comprises first storage capillaries which are smaller than the first conveying capillaries and second storage capillaries which are larger than the first conveying capillaries, and the second storage capillaries define the substantial majority of the capillaries in the storage.

24. A utensil as claimed in claim 23, wherein the capillaries in the conveying line define diameters substantially between approximately 0.01 mm and 0.05 mm and the capillaries in the storage define diameters substantially between approximately 0.02 mm and 0.5 mm.

25. A method of operating a fluid dispensing utensil having a fluid storage container, and a capillary conveying line for conveying fluid from the fluid storage container to the exterior of the utensil, the method comprising the steps of:

providing a capillary storage in direct contact with the capillary conveying line;

substantially maintaining a predetermined vacuum pressure within the fluid storage container;

maintaining a majority of the capillary storage in a substantially fluid-free state while the predetermined vacuum pressure is maintained within the fluid storage container;

transferring fluid from the fluid storage container to a predetermined portion of the capillary storage in response to a decrease in the predetermined vacuum pressure within the fluid storage container; and transferring fluid from the predetermined portion of the capillary storage to the fluid storage container in response to an increase in the vacuum pressure within the fluid storage container.

26. A method as claimed in claim 25, further comprising the step of:

controlling air flow into the fluid storage container with the capillary conveying line.

27. A method as claimed in claim 25, further comprising the step of:

returning the predetermined portion of the capillary storage to the substantially fluid-free state in response to an increase in the vacuum pressure within the fluid storage container to approximately the predetermined vacuum pressure.

28. A writing utensil, comprising:

a container defining a first storage area for storing writing fluid, a second storage area and an opening therebetween;

a tip;

a capillary conveying line completely filling the opening and extending from the opening through at least a portion of the second storage area to the tip, the capillary conveying line defining a first predetermined average capillarity and a first predetermined uppermost capillarity; and a capillary storage associated with the second storage area, in direct contact with the capillary conveying line, and separated from the first storage area such that the capillary storage only comes into contact with writing fluid from the first storage area by way of the capillary conveying line, the capillary storage defining a second predetermined average capillarity and a second predetermined uppermost capillarity, the second predetermined average capillarity being substantially less than the first predetermined average capillarity and the second predetermined uppermost capillarity being substantially less than the first predetermined uppermost capillarity.

29. A utensil as claimed in claim 28, further comprising:

a partition separating the first and second storage areas, the partition having a hole which defines the opening between the first and second storage areas, the hole being completely filled by the capillary conveying line.

30. A utensil as claimed in claim 29, wherein the partition comprises a tube that extends to approximately the bottom of the container and the hole is substantially adjacent to the bottom of the container.

31. A utensil as claimed in claim 28, wherein the capillary conveying line comprises first capillaries adapted to transport air and second capillaries adapted to transport writing fluid.

32. A utensil as claimed in claim 28, wherein the capillary conveying line and the capillary storage define a single unitary structure.

33. A utensil as claimed in claim 28, wherein the capillary conveying line comprises first capillaries adapted to transport air and second capillaries adapted to transport writing fluid and is compressed within the opening in such a manner that the first capillaries define the sole path for air travel into the container.

34. A utensil as claimed in claim 28, wherein the capillary storage comprises a foam material.

35. A utensil as claimed in claim 34, wherein the foam material comprises a reticulated foam.

36. A utensil as claimed in claim 34, wherein the foam material is substantially hydrophilic.

37. A utensil as claimed in claim 34, wherein the foam material is substantially hydrophobic.

38. A utensil as claimed in claim 28, wherein the capillary conveying line comprises a porous plastic tube.

39. A utensil as claimed in claim 28, wherein the capillary conveying line comprises first conveying capillaries adapted to transport air and second conveying capillaries adapted to transport writing fluid, the storage comprises first storage capillaries which are smaller than the first conveying capillaries and second storage capillaries which are larger than the first conveying capillaries, and the second storage capillaries define the substantial majority of the capillaries in the storage.

40. A utensil as claimed in claim 39, wherein the capillaries in the conveying line define diameters substantially between approximately 0.01 mm and 0.05 mm and the capillaries in the storage define diameters substantially between approximately 0.02 mm and 0.5 mm.

41. A utensil as claimed in claim 28, wherein the second predetermined average capillarity is substantially less than the first uppermost predetermined capillarity.

42. A fluid dispensing utensil, comprising:

a container defining a first storage area for storing fluid, a second storage area and an opening therebetween;

a tip;

a conveying line completely filling the opening and extending from the opening through at least a portion of the second storage area to the tip, the conveying line including conveying line capillary material defining a first predetermined average capillarity and a first predetermined uppermost capillarity; and a capillary storage associated with the second storage area, in direct contact with the conveying line, and separated from the first storage area such that the capillary storage only comes into contact with fluid from the first storage area by way of the conveying line, the capillary storage defining a second predetermined average capillarity and a second predetermined uppermost capillarity, the second predetermined average capillarity being substantially less than the first predetermined average capillarity and the second predetermined uppermost capillarity being substantially less than the first predetermined uppermost capillarity.

43. A utensil as claimed in claim 42, further comprising:

a partition separating the first and second storage areas, the partition having a hole which defines the opening between the first and second storage areas, the hole being completely filled by the conveying line.

44. A utensil as claimed in claim 42, wherein the conveying line capillary material comprises first capillaries adapted to transport air and second capillaries adapted to transport fluid.

45. A utensil as claimed in claim 42, wherein the second predetermined average capillarity is substantially less than the first uppermost predetermined capillarity.

46. A utensil as claimed in claim 42, wherein the conveying line capillary material comprises first conveying capillaries adapted to transport air and second conveying capillaries adapted to transport fluid, the storage comprises first storage capillaries which are smaller than the first conveying capillaries and second storage capillaries which are larger than the first conveying capillaries, and the second storage capillaries define the substantial majority of the capillaries in the storage.

47. A fluid dispensing utensil as claimed in claim 42, wherein the container is adapted to store a relatively large volume of fluid in such a manner that the fluid is allowed to flow freely therein.

48. A writing utensil as claimed in claim 28, wherein the container is adapted to store a relatively large volume of writing fluid in such a manner that the writing fluid is allowed to flow freely therein.

49. A fluid dispensing utensil as claimed in claim 3, wherein the container is adapted to store a relatively large volume of fluid in such a manner that the fluid is allowed to flow freely therein.

50. A writing utensil as claimed in claim 1, wherein the container is adapted to store a relatively large volume of writing fluid in such a manner that the writing fluid is allowed to flow freely therein.

* * * * *